US009868025B2

(12) United States Patent
Cygan et al.

(10) Patent No.: US 9,868,025 B2
(45) Date of Patent: Jan. 16, 2018

(54) CONTRALATERAL HIP AND HAMSTRING TRAINING DEVICE

(71) Applicant: GYMBOT, LLC, Lake Zurich, IL (US)

(72) Inventors: Brian Cygan, Wauconda, IL (US); Nicolas Andrew Bartolotta, Venice, CA (US)

(73) Assignee: GYMBOT, LLC, Lake Zurich, IL (US)

( * ) Notice: Subject to any disclaimer, the term of this patent is extended or adjusted under 35 U.S.C. 154(b) by 10 days.

(21) Appl. No.: 15/172,092

(22) Filed: Jun. 2, 2016

(65) Prior Publication Data

US 2016/0354627 A1 Dec. 8, 2016

Related U.S. Application Data

(60) Provisional application No. 62/169,990, filed on Jun. 2, 2015.

(51) Int. Cl.
*A63B 21/008* (2006.01)
*A63B 23/04* (2006.01)
(Continued)

(52) U.S. Cl.
CPC .... *A63B 23/03508* (2013.01); *A63B 21/0058* (2013.01); *A63B 21/0083* (2013.01); *A63B 21/4033* (2015.10); *A63B 21/4047* (2015.10); *A63B 23/0482* (2013.01); *A63B 24/0087* (2013.01); *A63B 71/0622* (2013.01); *G05G 9/047* (2013.01); *A63B 21/0087* (2013.01);
(Continued)

(58) Field of Classification Search
CPC ..... A63B 2071/1233; A63B 23/03508; A63B 23/04; A63B 23/0405; A63B 23/0494; A63B 23/0482; A63B 23/4047; A63B 21/0083; A63B 21/0085; A63B 21/0087; A63B 21/0088
See application file for complete search history.

(56) References Cited

U.S. PATENT DOCUMENTS 4,776,587 A 10/1988 Carlson et al.
4,930,768 A * 6/1990 Lapcevic ..... A63B 21/00072 482/100
(Continued)

FOREIGN PATENT DOCUMENTS

DE 29608366 U1 * 10/1996 ..... A63B 23/0494

*Primary Examiner* — Nyca T Nguyen
(74) *Attorney, Agent, or Firm* — Loza & Loza, LLP; Heidi L. Eisenhut

(57) ABSTRACT

A contralateral hip and hamstring training device which mimics the body position and biomechanics of walking/running is provided. When using the training device, a user is positioned in a partially supported lunge with the front hip flexed just above 90 degrees and the back hip extended to at least neutral at the hip by use of an incline bench or seat pad with no seat back. This position allows users to engage the hip flexors of their back leg while the hamstring exercise is performed on the front leg creating true pelvic stabilization using the same counterforce mechanics required during walking/running. Because the user is able to adjust the amount of hip extension and muscle activation on the back leg in real time, the training device provides for adequate leverage for training the hamstrings in both Hip Extension and Knee Flexion simultaneously and through a full range of resistance levels.

20 Claims, 9 Drawing Sheets

(51) Int. Cl.

| | |
|---|---|
| ***A63B 23/035*** | (2006.01) |
| ***A63B 24/00*** | (2006.01) |
| ***A63B 71/06*** | (2006.01) |
| ***A63B 21/005*** | (2006.01) |
| ***G05G 9/047*** | (2006.01) |
| *A63B 23/00* | (2006.01) |
| *A63B 21/055* | (2006.01) |
| *A63B 21/00* | (2006.01) |
| *A63B 21/22* | (2006.01) |
| *A63B 69/00* | (2006.01) |
| *A63B 21/062* | (2006.01) |

(52) U.S. Cl.

CPC ..... *A63B 21/0552* (2013.01); *A63B 21/0628* (2015.10); *A63B 21/159* (2013.01); *A63B 21/225* (2013.01); *A63B 2023/006* (2013.01); *A63B 2069/0062* (2013.01); *A63B 2071/065* (2013.01); *A63B 2071/0658* (2013.01); *A63B 2208/0209* (2013.01); *A63B 2225/09* (2013.01)

(56) References Cited

U.S. PATENT DOCUMENTS

| | | | | |
|---|---|---|---|---|
| 5,356,360 | A * | 10/1994 | Johns | A63B 21/155 482/100 |
| 5,409,438 | A | 4/1995 | Jones et al. | |
| 6,361,482 | B1 * | 3/2002 | Batca | A63B 23/0355 482/100 |
| 6,558,303 | B1 * | 5/2003 | Ellis | A63B 23/0494 482/100 |
| 6,676,574 | B1 * | 1/2004 | Prokop | A63B 21/0615 482/100 |
| 7,537,551 | B2 | 5/2009 | Steffee | |
| 7,563,209 | B2 | 7/2009 | Webber et al. | |
| 2003/0092541 | A1 * | 5/2003 | Giannelli | A63B 21/155 482/99 |
| 2007/0225129 | A1 | 9/2007 | Maresh | |
| 2007/0254787 | A1 * | 11/2007 | Matsubara | A63B 21/0058 482/139 |
| 2008/0058177 | A1 * | 3/2008 | Webber | A63B 21/0615 482/94 |

* cited by examiner

CONTRALATERAL HIP AND HAMSTRING TRAINING DEVICE

CROSS REFERENCE TO RELATED APPLICATIONS

This application claims priority to a provisional application, U.S. Ser. No. 62/169,990, filed Jun. 2, 2015, entitled EXERCISE MACHINE, which is hereby incorporated by reference.

FIELD

The present disclosure relates to an exercise machine and more particularly a contralateral hip and hamstring training device that can be used for strength training and flexibility and is designed for hamstrings' unique biomechanics in mind addressing the ergonomic needs of a muscle that has dual primary actions.

BACKGROUND

The hamstrings as a muscle group cross both the hip joint and the knee joint and are one of the most critical muscles used for locomotion (walking/running). The biomechanics of the hamstrings are such that they create tremendous amounts of force for both hip extension and knee flexion. In fact, they are unique in that they are one of the only muscle groups in the human body that cross two joints and are classified as primary movers for both joints. Usually the mechanics of a two joint muscle are such that there is greater leverage at one joint over the other and the actions of the muscle are thus classified as primary (stronger of the two actions) and secondary (weaker of the two actions). For example, the calf muscle (gastrocnemius) crosses both the knee joint and the ankle joint and is considered a primary ankle flexor and a secondary knee flexor. This means that the calf generates significantly more force at the ankle then at the knee and as such it is best strengthened by exercises that focus on creating resistance for ankle flexion versus knee flexion. The fact that the hamstrings generate equivalent forces at both the hip and the knee makes it one of the most challenging muscle groups to isolate for strength training in the body. The current methodology for equipment design is to determine a muscle's primary action, stabilize the body for that action, and then provide adequate resistance to the muscle during that action. This works extremely well with muscles that have only one primary action like the calf (e.g. using a heel raise machine). However, with the hamstrings, which have dual primary actions, engineers have erroneously created equipment that attempts to isolate one action from the other. As such we see machines like the Seated or Prone Hamstring Curl Machine for knee flexion, and the Donkey Kick Machine for hip extension which are well known in the industry. In these current designs an improper understanding of the biomechanics of the hamstrings has led to poor ergonomics and an inability to maximize strengthening of the hamstrings muscle group.

Specific Biomechanics of the Hamstrings

As mentioned above the hamstrings are used for walking and running, and understanding the biomechanics of the hamstrings during those activities is necessary to design an ergonomically sound strength-training machine. When we walk or run our hamstrings contract on our forward leg simultaneously with the antagonist muscle groups on our tailing leg (hip flexors/quads). This creates a synchronized counter force that propels us forward during the gait cycle. The critical point here is that the hamstrings require a counterforce from the opposite leg in order to stabilize the pelvis and create adequate leverage for the muscle to contract. Without this leg position and the resulting counterforce the pelvis will rotate either anteriorly or posteriorly in a compensatory pattern that disengages the hamstrings muscle. When this compensation occurs, the force demand being placed on the hamstrings is passed from the muscle belly to the supporting structures (tendons/ligaments/joints) or to other muscles that are not the intended target for the exercise. This phenomenon can be seen by looking at the two most widely used exercise machines for the hamstrings on the market, the Seated Hamstring Curl and the Prone Hamstring Curl Machines.

With the seated variation, users are stabilized in a seated position with a thigh pad that locks into a fixed position across the top of their femurs just above their knees. They use both legs, flexing (bending) their knees and pulling a weighted armature of the machine in an arc under the seat and towards the back of their thighs. This machine stabilizes the femurs with the fixed pad and attempts to provide stability to the pelvis using the sitting posture and the back of the seat. With small amounts of resistance it does provide adequate leverage to target the lower portion of the hamstrings. However, as soon as even a moderate amount of resistance is provided the user's pelvis immediately destabilizes, rotating posteriorly, and forcing them to use their calf muscles (secondary knee flexors) to perform the exercise. This compensation pattern also creates a tremendous shearing force at the knees stressing the ligaments and potentially straining the hamstring tendons. Users of this machine commonly report that the sensation during the exercise is focused behind their knees or in their calf muscles as opposed to the belly of the hamstrings muscle.

The Prone Hamstring Curl Machine demonstrates a second compensation pattern. The user lays on the machine face down in a prone position and attempts to flex both of their knees at the same time pulling a weighted armature in an arc up and towards the back of their thighs. This machine stabilizes the femurs using the weight of the body against the surface of the table/bench and attempts to stabilize the pelvis by positioning the hips in an extended position. As with the seated variation of this machine, when using very light resistance it does provide adequate leverage to target the hamstrings. However, as soon as a moderate amount of resistance is provided the pelvis rotates (this time anteriorly) and the lumbar erector muscles (lower back muscles) compensate in order to perform the exercise. This compensation pattern also creates excessive stress to the facets and anterior pressure to the intervertebral discs of the lumbar spine. Users of this machine commonly report fatigue and/or pain in their lower back. It is clear that using a seated or prone position for performing strength training for the hamstring only works with extremely light resistance and potentially causes harm/damage to the body when moderate or heavy resistance is applied. The reason these machines are not functional is because they are designed with poor ergonomics (minimal pelvic stabilization) and with the intension to isolate knee flexion and ignore the hip extension component of the hamstrings entirely. There is also a fairly ubiquitous machine (The Donkey Kick machine) that attempts to isolate hip extension and ignores knee flexion with equally mediocre results in terms of strength training for the hamstrings.

In view of the above, what is needed is a contralateral hip and hamstring training device that can be used for strength training and flexibility and is designed for hamstrings' unique biomechanics in mind addressing the ergonomic needs of a muscle that has dual primary actions.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one aspect, a contralateral hip and hamstring training device is provided. The training device comprises a main frame having a base section; a user support mounted on the main frame; a hip extension assembly pivotally secured to the main frame; and a resistance assembly mounted on the main frame and connected to the hip extension assembly for producing pivotal movement of the hip extension assembly about a pivot axis. The user support comprises a rearwardly inclined seat member having a seat pad mounted to elongated user support vertical members extending upwardly from the base section main frame. The hip extension assembly comprises a pair of spaced apart horizontal support members having a first end and a second end; a first tubular arm fixedly connected to the first end of the spaced apart horizontal support members and pivotally secured to a pair of pivot brackets on the main frame; a second tubular arm fixedly connected to the second end of the spaced apart horizontal support members and an adjustable user engaging assembly; a pad mounting member, having a leg engaging pad telescopically mounted over the pad mounting member, pivotally attached to the second tubular arm; and a thigh restraint assembly mounted to a cross support member connected between a pair of spaced apart vertical hip extension support members of the main frame, the thigh restraint assembly having a thigh restraint configured to float freely during use.

According to one feature, each spaced apart hip extension support member in the pair of spaced apart hip extension support members comprises a pair of side vertical supports of unequal length and an inclined horizontal support extending between the pair of side vertical supports.

According to another feature, the base section of the main frame comprises first, second and third parallel base struts connected by a first cross member; and a second cross member connecting the first and second parallel base struts. The elongated user support vertical members extend upwardly from the third parallel base strut to the user support.

According to yet another feature, the base section further comprises a first base support and a second base support, parallel to the first base support, mounted on top of and connecting the first and second struts. The pair of spaced apart hip extension support members extend upwardly from the first and second base supports.

According to yet another feature, the adjustable user engaging assembly is configured for longitudinally adjusting the leg engaging pad to accommodate a variety of lower leg lengths and comprises an aperture plate having a plurality of apertures; an adjustable plate fixedly attached to the pad mounting member; and a spring-loaded pin engaged within an aperture in the plurality of apertures.

According to yet another feature, the thigh restraint assembly further comprises a support bracket fixedly attached to and extending upwardly from the cross support member; a third tubular member, having a first tubular end and a second tubular end, secured to the support bracket at the first tubular end; and a thigh restraint hinge assembly secured to the second tubular end of the third tubular member.

According to yet another feature, the thigh restraint hinge assembly comprises a thigh restraint mounting member having a thigh restraint pad mounted thereon, pivotally attached to the third tubular arm by a pivot bracket.

According to yet another feature, the support bracket has a U-shaped configuration.

According to yet another feature, the thigh restraint assembly further comprises an aperture plate having aperture; an adjustable plate fixedly attached to the thigh restraint mounting member; a spring-loaded pin releasably engaged within the aperture, the spring-loaded pin freely moves within the aperture when in a released configuration. The aperture may have a generally arc shaped configuration.

According to yet another feature, the resistance assembly comprises a linear actuator having a cylinder and a piston axially engaged with the cylinder; a motor secured to, and in electrical communication with, the linear actuator; and wherein the piston is attached to a lever connected to the pair of spaced apart horizontal support members.

According to yet another feature, the piston acts upon the lever causing the pair of spaced apart horizontal support members to rotate about the pivot axis which in turn rotates the pad of the hip extension assembly around the pivot axis.

According to yet another embodiment, the training device further comprises a display support member mounted to the pair of vertical hip extension members; and a display secured to the display support member. The display shows a force applied to the leg engaging pad in real time compared to a predetermined strength curve.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

Figure 1A:
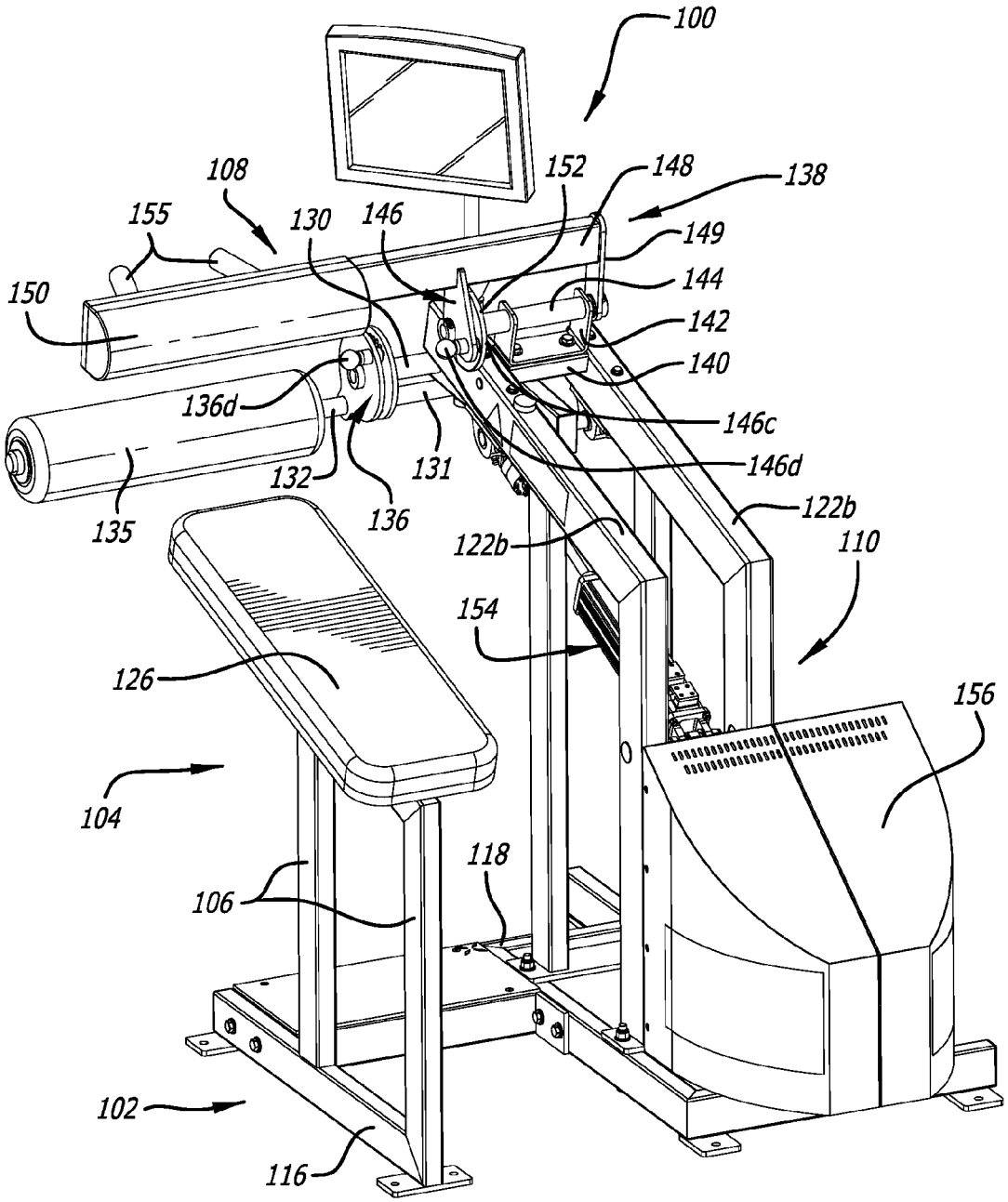
FIG. 1A is a back right perspective view of a contralateral hip and hamstring training device according to the present disclosure.

In the following description, specific details are given to provide a thorough understanding of the embodiments. However, it will be understood by one of ordinary skill in the art that the embodiments may be practiced without these specific details.

Overview

Certain embodiments of the present disclosure are directed to an exercise machine, more specifically to a contralateral hip and hamstring training device that addresses the compensation patterns and muscle recruitment challenges, as discussed above, through implementing at least two (2) novel design features. A first novel feature, "Active Bilateral Stabilization", may be achieved by mimicking the body position and biomechanics of walking/running.

The contralateral hip and hamstring training device of the present disclosure allows for true hamstring isolation and progressive hip flexor work at the same time. Unlike a traditional hamstring machine where the user sits with both legs forward, which is a non-optimal position as it allows the user's back to collapse, when using the training device of the present disclosure the user is positioned in a partially supported lunge with the front hip flexed just above 90 degrees and the back hip extended to at least neutral at the hip. This is achieved with an incline bench or seat pad with no seat back. This position allows users to engage the hip flexors of their back leg while the hamstring exercise is performed on the front leg. This creates true pelvic stabilization using the same counterforce mechanics required during walking/running. Because the user is able to adjust the amount of hip extension and muscle activation on the back leg in real time, this design feature may be designated "Active Bilateral Stabilization." It is important to note this position and stabilization method is the only way to provide adequate leverage for training the hamstrings in both hip extension and knee flexion simultaneously and through a full range of resistance levels.

A second novel feature, "Adaptive Passive Restraint", is vital to the user experience and safety while working on the contralateral hip and hamstring training device. In order to stabilize the user's front leg to perform a hamstring contraction there is a thigh restraint that contacts the thigh just above the knee. However, unlike existing machines the thigh restraint on the contralateral hip and hamstring training device does not lock into position, instead it is floating on a hinge and allows the front thigh to move up or down as needed during the exercise. By allowing the thigh restraint to float instead of being in a fixed stationary position, stress is kept out of the knee as the knee is allowed to modulate, i.e. at different ranges of motion the knee will rise and fall as the ergonomics and posture of the front leg require.

The contralateral hip and hamstring training device may include handles on top of the thigh restraint that allow the user to adapt the position and amount of pressure transferred from the restraint to the thigh, thus the designation "Adaptive Passive Restraint." It is adaptive because it will naturally adjust to the appropriate position throughout the exercise, and it is passive because the user is not specifically engaging any muscles in the leg to control this stabilizing force. This feature, as well as the Active Bilateral Stabilization feature, are at least some of the features which set the contralateral hip and hamstring training device apart in both form and function. For the hamstrings both of these novel elements are necessary for full belly activation, joint comfort, user defined muscle lengthening and real-time postural progressions. The novel mechanism makes eccentric loading efficacious (targeted and tolerable). Without these precise mechanics, high effort eccentric activation is not possible due to dangerous levels of sheer forces at the knee.

Due to the bilateral nature of the exercise performed on the contralateral hip and hamstring training device, there is a secondary strengthening and active stretching effect on the hip flexors concurrently. The ergonomics of the contralateral hip and hamstring training device are such that resistance can be provided both for concentric and eccentric muscle loading without risk of compensation or harm to the supporting structures allowing for any form of resistance to be used with the training device. Examples of resistance sources that can be utilized with the contralateral hip and hamstring training device of the present disclosure include, but are not limited to, motorized, pneumatic, elastic, weight stack, weight plates, manually applied resistance, or any other type of resistance known in the art.

Contralateral Hip and Hamstring Training Device

Figure 1B:
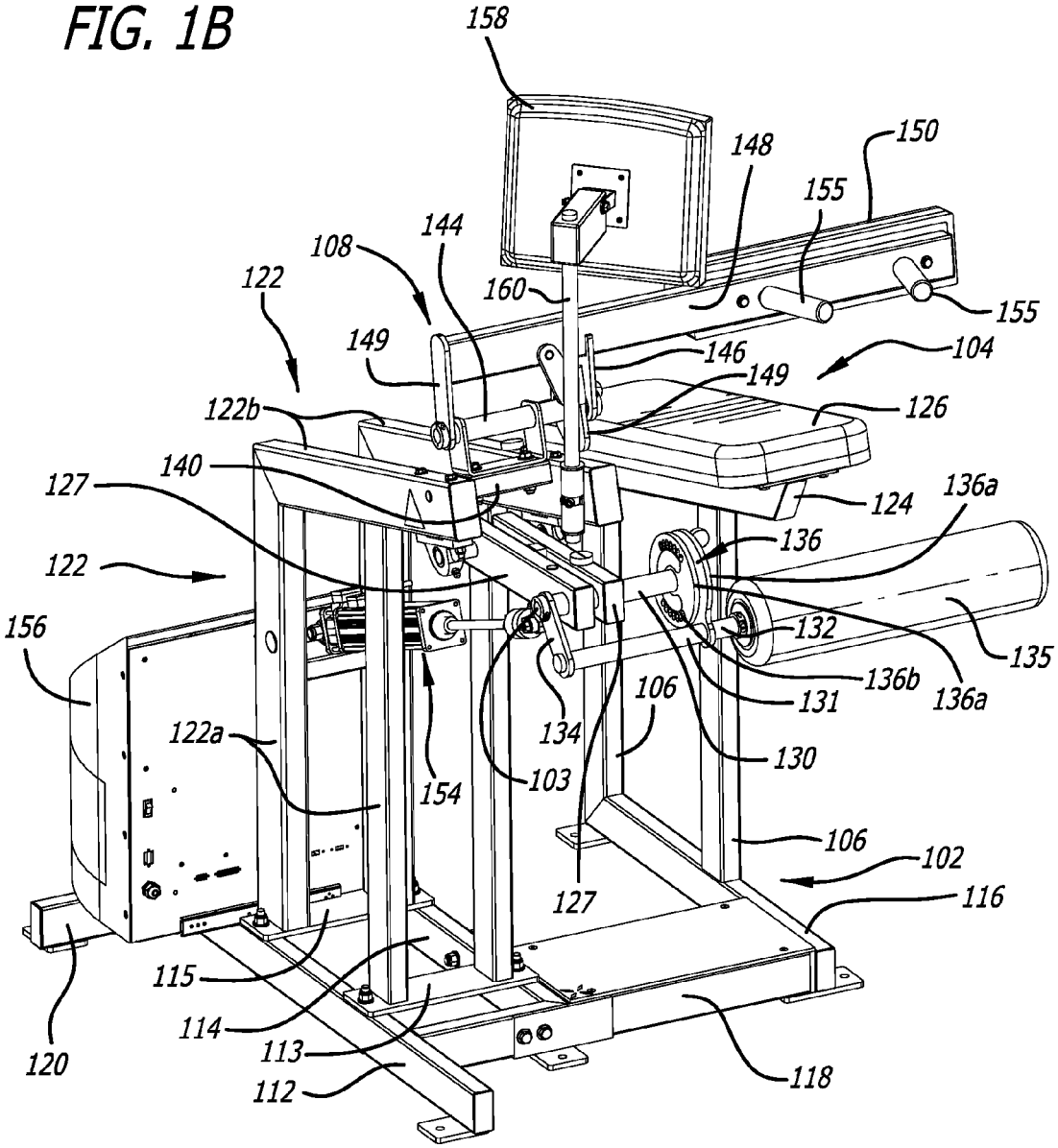
FIG. 1B is a front left perspective view of the contralateral hip and hamstring training device of FIG. 1A.
Figure 2A:
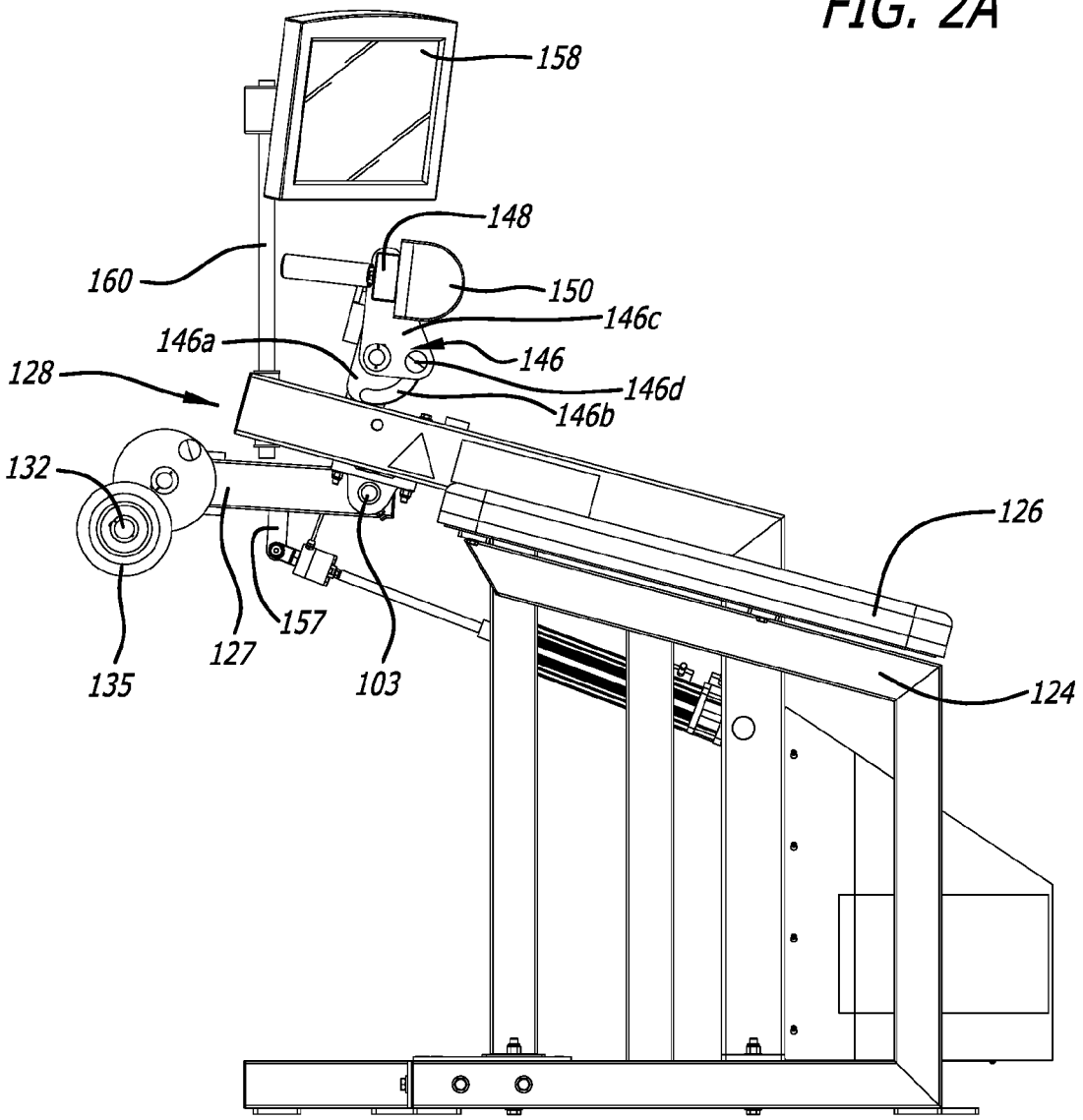
FIG. 2A is a right side elevation view of the contralateral hip and hamstring training device of FIG. 1A.
Figure 2B:
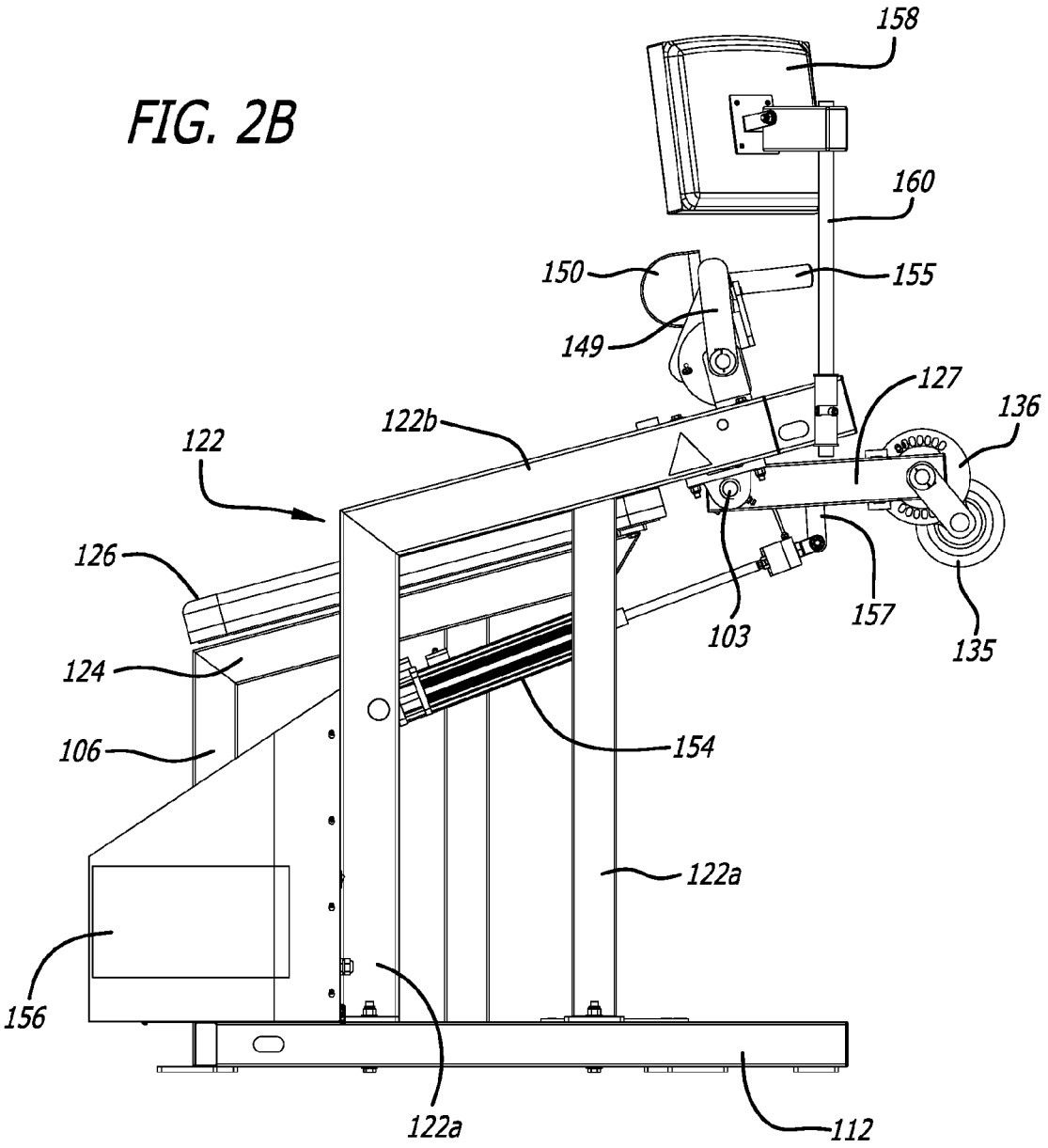
FIG. 2B is a left side elevation view of the contralateral hip and hamstring training device of FIG. 1A.
Figure 3:
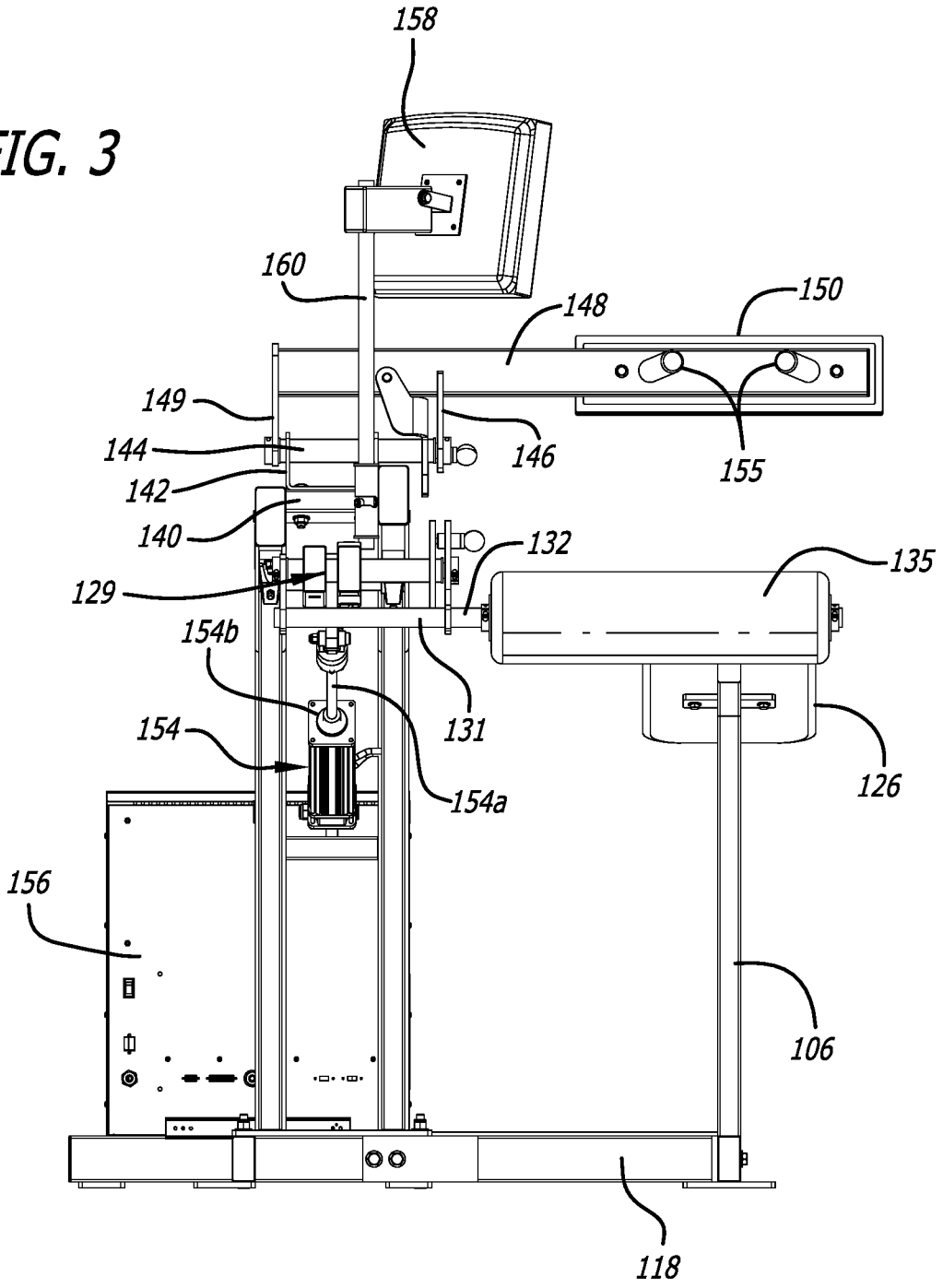
FIG. 3 is a front elevation view of the contralateral hip and hamstring training device of FIG. 1A.
Figure 4:
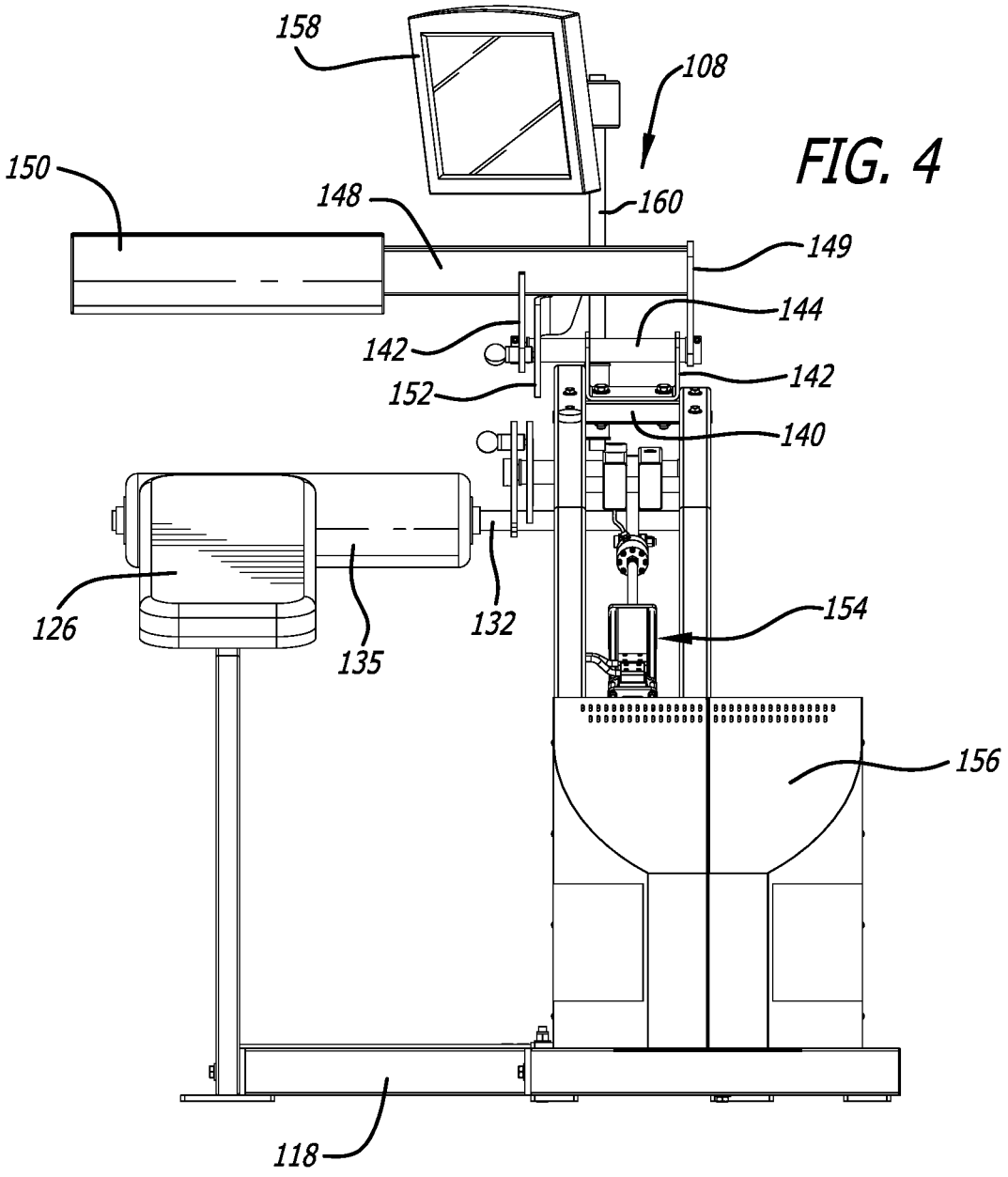
FIG. 4 is a back elevation view of the contralateral hip and hamstring training device of FIG. 1A.

FIG. 1A is a back right perspective view of a contralateral hip and hamstring training device according to the present disclosure. FIG. 1B is a front left perspective view of the contralateral hip and hamstring training device of FIG. 1A. FIG. 2A is a right side elevation view of the contralateral hip and hamstring training device of FIG. 1A. FIG. 2B is a left side elevation view of the contralateral hip and hamstring training device of FIG. 1A. FIG. 3 is a front elevation view of the contralateral hip and hamstring training device of FIG. 1A. FIG. 4 is a back elevation view of the contralateral hip and hamstring training device of FIG. 1A. The following discussion refers interchangeably to FIGS. 1A, 1B, 2A, 2B, 3 and 4.

As shown, the contralateral hip and hamstring training device 100 includes a main frame 102, a user support 104 mounted on the main frame 102, a hip extension assembly 108 pivotally secured to the frame and a resistance assembly 110 mounted on the frame and secured to the hip extension assembly 108 for producing pivotal movement of the hip extension assembly about a pivot axis.

The main frame 102 has a base section comprising first, second and third parallel base struts 112, 114, 116 connected by a first cross member 118 and a second cross member 120 connecting the first and second parallel base struts 112, 114. The main frame 102 further comprises elongated user support vertical members 106 extending upwardly from the third parallel base strut 116 of the base section to the user support 104 and spaced apart hip extension support members 122 extending upwardly from first and second base supports 113, 115 mounted on top of and connecting the first and second struts 112, 114 of the base section. Each of the spaced apart hip extension support members 122 comprises a pair of side vertical supports 122*a* of unequal lengths and an inclined horizontal support 122*b* extending between the pair of side vertical supports 122*a*.

The user support 104 may include an elongated seat member 124 with a seat pad 126 mounted to the elongated user support vertical members 106 of the main frame 102. As shown, the elongated user support vertical members 106 may be of unequal lengths providing for a rearwardly inclined seat member 124 and seat pad 126.

The hip extension assembly 108 comprises a pair of spaced apart hip extension horizontal support members 127 having a first end and a second opposing end. The first end of the horizontal support members 127 are secured to a first tubular arm 131 which is rotatably mounted to a pair of pivot brackets 129 fixedly secured to the underside of the inclined horizontal supports 122*b* of the spaced apart hip extension support members 122. The pair of spaced apart hip extension horizontal support members 127 are adapted to rotate about a pivot axis 103 of the pair of pivot brackets, as described in further detail below.

The hip extension assembly 108 further comprises a second tubular arm 130 fixedly connected to the second ends of the spaced apart horizontal support members 127 at one end and an adjustable user engaging assembly 136 at a second opposing end, and a pad mounting member 132 with a leg engaging roller or pad 135 telescopically mounted over the pad mounting member 132 pivotally attached to the second tubular arm 130 by a pivot bracket 134. The adjustable user engaging assembly 136, for longitudinally adjusting the leg engaging roller or pad 135 to accommodate a variety of lower leg lengths, includes an aperture plate 136*a* having a plurality of apertures 136*b* and an adjustable plate 136*c* fixedly attached to the pad mounting member 132.

The longitudinal adjustment may be accomplished using a spring-loaded pin 136*d* secured to the adjustable plate 136*c* by selectively engaging the spring-loaded pin in the plurality of apertures 136*b* in the aperture plate 136*a*. To then longitudinally adjust the leg engaging roller or pad 135, the spring-loaded pin 136*d* may be withdrawn from one of the apertures in the aperture plate 136*a*, relocate the leg engaging roller or pad 135, and allow the spring-loaded pin 136*d* to engage another one of the apertures in the aperture plate 136*a*.

The hip extension assembly 108 further comprises and a thigh restraint assembly 138 pivotally mounted to a cross support member 140 connected between the spaced apart vertical hip extension support members 122. The thigh restraint assembly 138 comprises a support bracket 142 fixedly attached to and extending upwardly from the cross support member 140, a third tubular arm 144 secured to the support bracket 142 at one end and a thigh restraint hinge assembly 146 at a second opposing end, and a thigh restraint mounting member 148, with a thigh restraint pad 150 mounted thereon, pivotally attached to the third tubular arm 144 by a pivot bracket 149. The support bracket 142 may have a generally U-shaped configuration. According to one embodiment, the thigh restraint support member 148 may be provided with one or more handles 155 conveniently within the reach of the user.

The thigh restraint hinge assembly 146 allows the thigh restraint to hingedly float on the front thigh of a user and move up or down on the front thigh as needed during use when the leg engaging roller or pad 135, and subsequent leg of the user, moves in an arc. In other words, the thigh restraint assembly 138 does not lock into position when in use but instead floats on top of the front thigh of the user.

As shown in FIG. 2A, the thigh restraint hinge assembly 146 comprises an aperture plate 146*a* having an aperture 146*b* and an adjustable plate 146*c* fixedly attached to the thigh restraint mounting member 148. The hingedly floating of the thigh restraint hinge assembly 146 may be accomplished using a spring-loaded pin 146*d* secured to the adjustable plate 146*c* by releasing the spring-loaded pin 146*d* allowing the spring-loaded pin 146*d* to move freely within the aperture 146*b* on the aperture plate 146*a* when in a released configuration. The aperture may have a generally arc shaped configuration.

As shown, the resistance assembly 110 may comprise a linear actuator 154 and a motor 156, such as an isokinetic motor, for moving a piston 154*a* of the actuator axially. The cylinder 154*b* of the actuator 154 is secured to, an in electrical communication with, the motor 156 and the piston 154*a* is attached to a lever 157 connected to the spaced apart horizontal support members 127. When the piston 154*a* acts on the lever 157 it causes the spaced apart horizontal support members 127 to rotate about the pivot axis 103 which in turn rotates the pad 135 of the hip extension assembly 108 around the pivot axis 103. Although the resistance assembly 110 is illustrated as a motor, this is by way of example only. The resistance assembly 100 can be formed of gravity based resistance (e.g. a weight stack or weight plates), elastic resistance, fly wheel resistance, pneumatic resistance or any other type of resistance known in the art.

Figure 7:
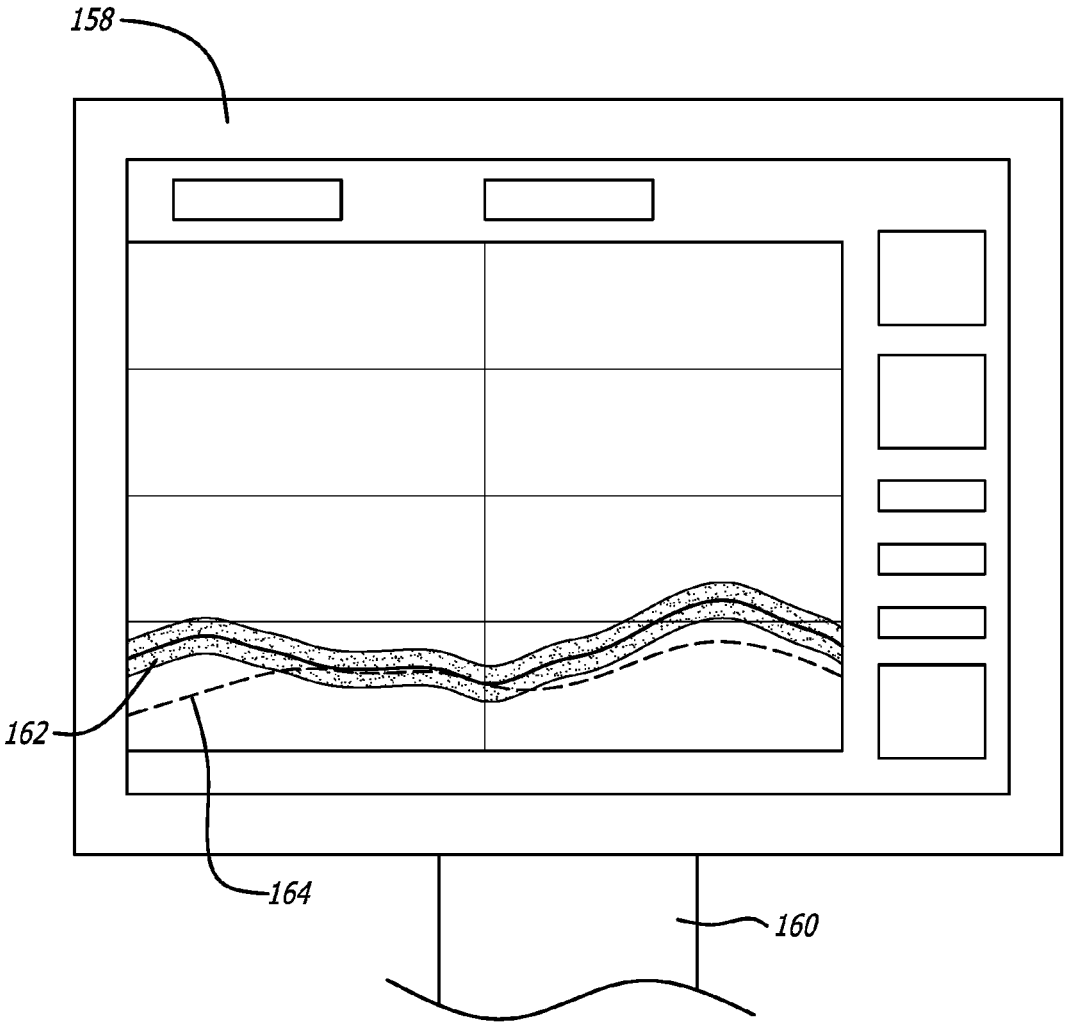
FIG. 7 is a display showing the force being applied by a user in real time compared to a preset strength curve.

Optionally, the contralateral hip and hamstring training device 100 may further comprise a display 158 allowing the user to measure the force being applied in real time. The display is mounted to the one of the vertical hip extension support members 122 with a display support member 160. FIG. 7 illustrates is a display showing the force being applied by a user 164 in real time compared to a preset or predetermined strength curve 162.

Figure 5:
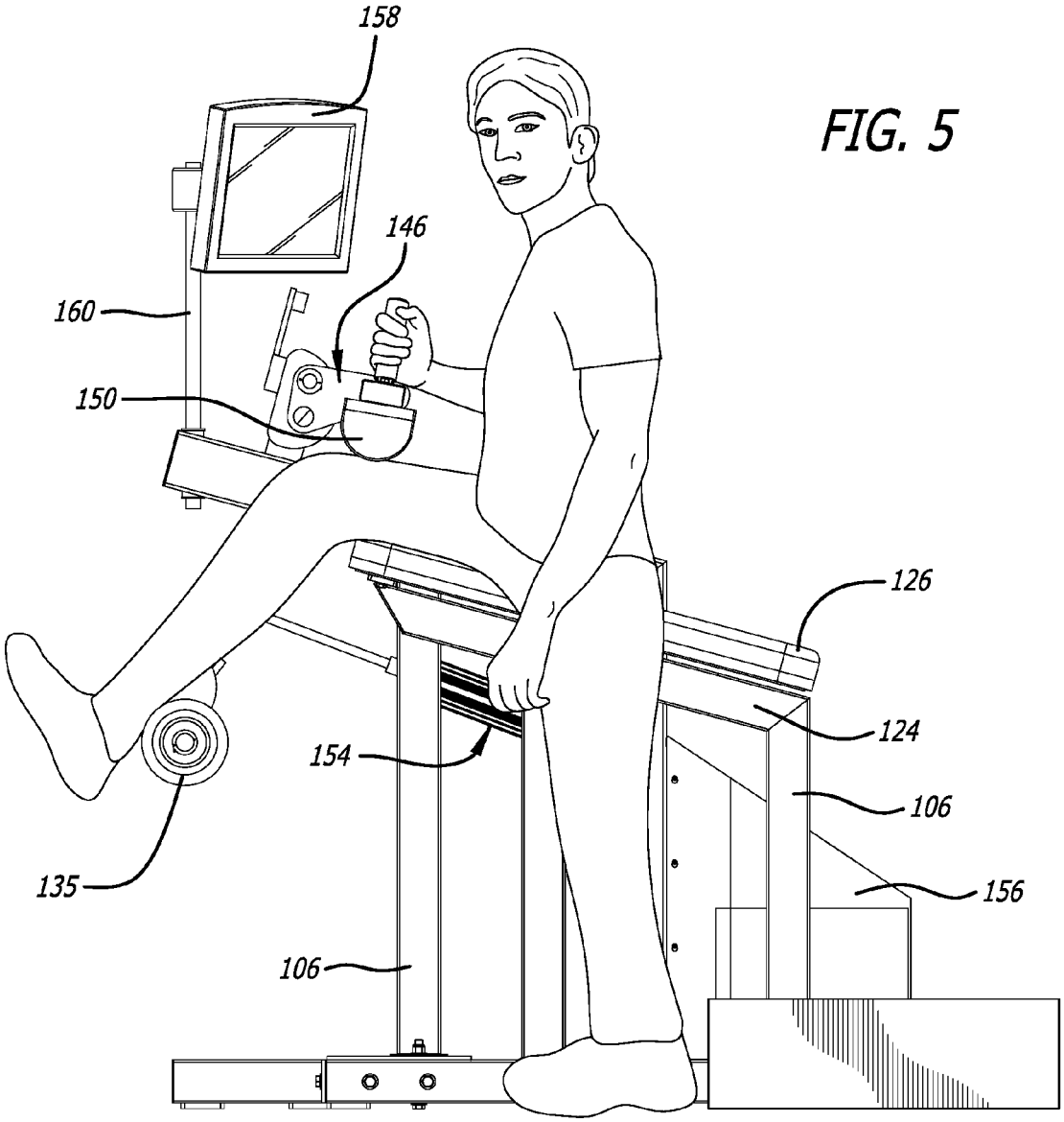
FIG. 5 is a right side elevation view similar to FIG. 2A but illustrating a user in a position on the contralateral hip and hamstring training device in a starting or neutral position.

FIG. 5 illustrates a user in a position on the contralateral hip and hamstring training device in a starting or neutral position. As shown, the user rests one leg on the rearwardly inclined seat member 124 while the other leg remains on the ground in a hip neutral position. As such, the user is positioned in a partially supported lunge with the front hip flexed just above 90 degrees and the back hip extended to at least neutral at the hip.

Figure 6:
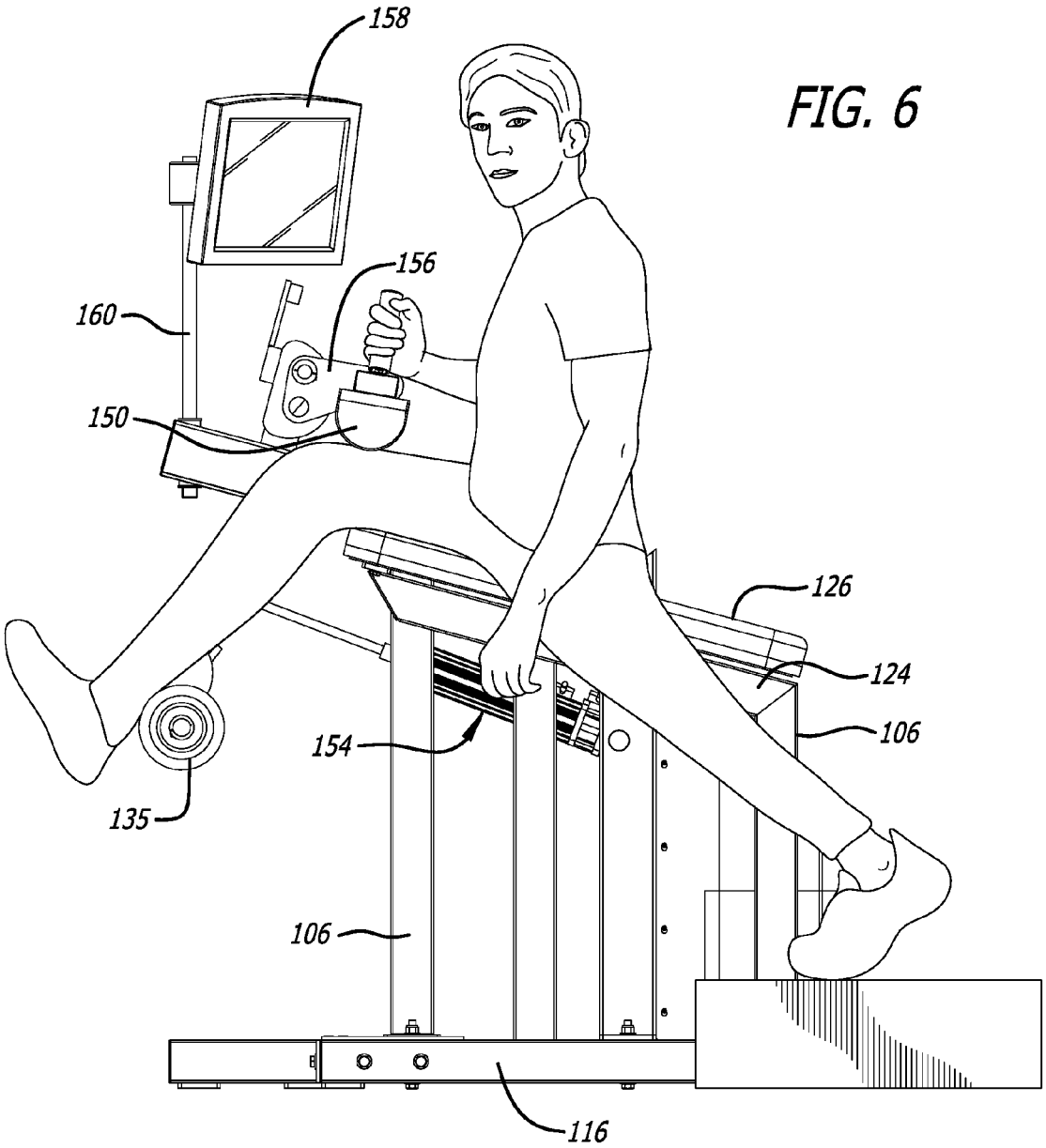
FIG. 6 is a right side elevation view similar to FIG. 2A but illustrating a user in a position on the contralateral hip and hamstring training device in a lunge position.

FIG. 6 illustrates a user in a position on the contralateral hip and hamstring training device in a lunge position. As shown, the user rests one leg on the rearwardly inclined seat member 124 while the other leg is positioned in a lunge allowing for deep hip flexor activation. As such, the user is positioned in a partially supported lunge with the front hip flexed just above 90 degrees and the back hip extended to a lunge position.

One or more of the components and functions illustrated in the figures may be rearranged and/or combined into a single component or embodied in several components without departing from the present disclosure. Additional elements or components may also be added without departing from the present disclosure. Additionally, the features described herein may be implemented in software, hardware, as a business method, and/or combination thereof.

While certain exemplary embodiments have been described and shown in the accompanying drawings, it is to be understood that such embodiments are merely illustrative of and not restrictive on the broad disclosure, and that this disclosure is not be limited to the specific constructions and arrangements shown and described, since various other modifications may occur to those ordinarily skilled in the art.

The invention claimed is:

1. A contralateral hip and hamstring training device, comprising:

a main frame having a base section;

a user support mounted on the main frame, the user support comprising a rearwardly inclined seat member having a seat pad mounted to elongated user support vertical members extending upwardly from the base section of the main frame;

a hip extension assembly pivotally secured to the main frame, the hip extension assembly comprising:

a pair of spaced apart horizontal support members having a first end and a second end;

a first tubular arm fixedly connected to the first end of the spaced apart horizontal support members and pivotally secured to a pair of pivot brackets on the main frame;

a second tubular arm fixedly connected to the second end of the spaced apart horizontal support members and an adjustable user engaging assembly;

a pad mounting member, having a leg engaging pad telescopically mounted over the pad mounting member, the pad mounting member pivotally attached to the second tubular arm; and a thigh restraint assembly mounted to a cross support member connected between a pair of spaced apart vertical hip extension support members of the main frame, the thigh restraint assembly having a thigh restraint configured to float freely during use; and a resistance assembly mounted on the main frame and connected to the hip extension assembly for producing pivotal movement of the hip extension assembly about a pivot axis.

2. The training device of claim 1, wherein the base section comprises first, second and third parallel base struts connected by a first cross member; and a second cross member connecting the first and second parallel base struts.

3. The training device of claim 2, wherein the elongated user support vertical members extend upwardly from the third parallel base strut to the user support.

4. The training device of claim 2, wherein the base section further comprises a first base support and a second base support, parallel to the first base support, mounted on top of and connecting the first and second struts.

5. The training device of claim 4, wherein pair of spaced apart vertical hip extension support members extend upwardly from the first and second base supports.

6. The training device of claim 1, wherein each spaced apart vertical hip extension support member of the pair of spaced apart hip extension vertical support members comprises a pair of side vertical supports of unequal length and an inclined horizontal support extending between the pair of side vertical supports.

7. The training device of claim 1, wherein the adjustable user engaging assembly is configured for longitudinally adjusting the leg engaging pad to accommodate a variety of lower leg lengths and comprises:

an aperture plate having a plurality of apertures;

an adjustable plate fixedly attached to the pad mounting member; and a spring-loaded pin releasably engaged within an aperture of the plurality of apertures.

8. The training device of claim 1, the thigh restraint assembly further comprises:

a support bracket fixedly attached to and extending upwardly from the cross support member;

a third tubular member, having a first tubular end and a second tubular end, secured to the support bracket at the first tubular end; and a thigh restraint hinge assembly secured to the second tubular end of the third tubular member.

9. The training device of claim 8, wherein the thigh restraint hinge assembly comprises:

a thigh the thigh restraint being restraint mounting member having a thigh restraint pad mounted on the thigh restraint mounting member, pivotally attached to the third tubular arm by a pivot bracket.

10. The training device of claim 8, wherein the support bracket has a U-shaped configuration.

11. The training device of claim 9, wherein the thigh restraint assembly further comprises:

an aperture plate having an aperture;

an adjustable plate fixedly attached to the thigh restraint mounting member;

a spring-loaded pin releasably engaged within the aperture, the spring-loaded pin freely moves within the aperture when in a released configuration.

12. The training device of claim 11, wherein the aperture has an arc shape.

13. The training device of claim 1, wherein the resistance assembly comprises:

a linear actuator having a cylinder and a piston axially engaged with the cylinder;

a motor secured to, and in electrical communication with, the linear actuator; and wherein the piston is attached to a lever connected to the pair of spaced apart horizontal support members.

14. The training device of claim 13, wherein the piston acts upon the lever causing the pair of spaced apart horizontal support members to rotate about the pivot axis which in turn rotates the leg engaging pad of the hip extension assembly around the pivot axis.

15. The training device of claim 1, further comprising:

a display support member mounted to the pair of vertical hip extension members; and a display secured to the display support member.

16. The training device of claim 15, wherein the display shows a force applied to the leg engaging pad in real time compared to a predetermined strength curve.

17. A contralateral hip and hamstring training device, comprising:

a main frame having a base section;

a user support mounted on the main frame, the user support comprising a rearwardly inclined seat member having a seat pad mounted to elongated user support vertical members extending upwardly from the base section of the main frame;

a hip extension assembly pivotally secured to the main frame, the hip extension assembly comprising:

a pair of spaced apart horizontal support members having a first end and a second end;

a first tubular arm fixedly connected to the first end of the spaced apart horizontal support members and pivotally secured to a pair of pivot brackets on the main frame;

a second tubular arm fixedly connected to the second end of the spaced apart horizontal support members and an adjustable user engaging assembly;

a pad mounting member, having a leg engaging pad telescopically mounted over the pad mounting member, the pad mounting member pivotally attached to the second tubular arm; and a thigh restraint assembly mounted to a cross support member connected between a pair of spaced apart vertical hip extension support members of the main frame, the thigh restraint assembly having a thigh restraint configured to float freely during use, the thigh restraint assembly comprising:

a support bracket fixedly attached to and extending upwardly from the cross support member;

a third tubular member, having a first tubular end and a second tubular end, secured to the support bracket at the first tubular end; and a thigh restraint hinge assembly secured to the second tubular end of the third tubular member; and a resistance assembly mounted on the main frame and connected to the hip extension assembly for producing pivotal movement of the hip extension assembly about a pivot axis.

18. The training device of claim 17, wherein the thigh restraint hinge assembly comprises:

a thigh the thigh restraint being restraint mounting member having a thigh restraint pad mounted on the thigh restraint mounting member, pivotally attached to the third tubular arm by a pivot bracket.

19. The training device of claim 18, wherein the thigh restraint assembly further comprises:

an aperture plate having an aperture;

an adjustable plate fixedly attached to the thigh restraint mounting member;

a spring-loaded pin releasably engaged within the aperture, the spring-loaded pin freely moves within the aperture when in a released configuration.

20. The training device of claim 18, wherein the resistance assembly further comprises:

a linear actuator having a cylinder and a piston axially engaged with the cylinder;

a motor secured to, and in electrical communication with, the linear actuator; and wherein the piston is attached to a lever connected to the pair of spaced apart horizontal support members; and wherein the piston acts upon the lever causing the pair of spaced apart horizontal support members to rotate about the pivot axis which in turn rotates the leg engaging pad of the hip extension assembly around the pivot axis.

* * * * *